US005987691A

United States Patent [19]

Jurt et al.

[11] Patent Number: 5,987,691

[45] Date of Patent: Nov. 23, 1999

[54] TOOTHBRUSH BRISTLES CONTAINING MICROFILAMENTS

[75] Inventors: Alfred Jurt; Franz Fischer, both of Triengen, Switzerland

[73] Assignee: Colgate-Palmotive Company, New York, N.Y.

[21] Appl. No.: 09/206,765

[22] Filed: Jul. 15, 1998

Related U.S. Application Data

[63] Continuation of application No. PCT/CH97/00001, Jan. 6, 1997.

[51] Int. Cl.[6] ..... A46B 9/04

[52] U.S. Cl. ..... 15/167.1; 15/207.2

[58] Field of Search ..... 15/167.1, 207.2

[56] References Cited

U.S. PATENT DOCUMENTS

| | | | |
|---|---|---|---|
| 792,471 | 6/1905 | Smith | 132/329 |
| 1,520,491 | 12/1924 | Weissleder | 433/216 |
| 2,160,731 | 5/1939 | Haeberlin | 15/167.1 |
| 2,887,340 | 5/1959 | Veneko | 300/21 |
| 3,577,839 | 5/1971 | Charvat et al. | 15/207.2 X |
| 3,613,143 | 10/1971 | Muhler et al. | 15/167.1 |
| 4,462,136 | 7/1984 | Nakao et al | 15/167.1 |
| 4,616,374 | 10/1986 | Novogrodsky | 15/167.1 |
| 4,646,381 | 3/1987 | Weihrauch | 15/167.1 |
| 5,249,327 | 10/1993 | Hing | 15/207.2 X |
| 5,345,645 | 9/1994 | Page | 15/167.1 |
| 5,722,106 | 3/1998 | Masterman et al. | 15/167.1 |
| 5,770,307 | 6/1998 | Rackley et al. | 428/373 |

FOREIGN PATENT DOCUMENTS

| | | | |
|---|---|---|---|
| 44 17 548 | 11/1995 | Germany . | |
| 479277 | 11/1969 | Switzerland . | |
| 490124 | 8/1938 | United Kingdom . | |
| 2137080 | 10/1984 | United Kingdom | 15/207.2 |

OTHER PUBLICATIONS

M. Pader, *Oral Hygiene Products and Practice*, Marcel Dekker, Inc., New York (1988), pp. 169–170.

*Primary Examiner*—Mark Spisich
*Attorney, Agent, or Firm*—Henry S. Goldfine

[57] ABSTRACT

This invention relates to soft, end rounded toothbrush bristles having significant surface area containing a plurality of microfilaments surrounded by a sheath, wherein the microfilaments project beyond the sheath.

6 Claims, 1 Drawing Sheet

TOOTHBRUSH BRISTLES CONTAINING MICROFILAMENTS

This is a continuation of international application number PCT/CH97/00001 filed Jan. 6, 1997.

BACKGROUND OF THE INVENTION

1. Field of the Invention

The present invention relates to a plastic bristle for toothbrushes and to a toothbrush provided with such bristles.

2. The Prior Art

Toothbrushing is generally known for its cleaning function, the remove food debris and plaque; but, it also massages the gingival tissue increasing keratinization which enhances gingival health, and in conjunction with an abrasive dentifrice removes the stained pellicle on the tooth surface to enhance tooth whiteness. The ability of a toothbrush to perform these functions is related to the size of the head, the distribution of the bristle tufts, the properties of the individual bristles as determined by their material of construction plus their size and shape, the bristles per tuft, and the configuration of the tufts themselves. In general the more surface area of bristle applied by the user to the tooth and gingival surface, the more plaque and debris that will be removed, the greater the massaging effect and the greater the removal of stained pellicle.

Today, virtually all commercial toothbrush bristles manufactured in the U.S. are made of polyamide (i.e. nylon). The stiffness of a nylon bristle is primarily related to the modulus i.e. resistance to bending of the particular nylon, and the filament diameter (i.e. thickness) and trim length. The stiffness of the nylon bristle, the number of bristles comprising a tuft, and the number of tufts in a brush are major variables involved in the classification of a toothbrush as "soft", "medium" or "firm"/"hard". Scientific studies have shown that the "softer" the brush the less it will abrade the soft gingival tissue surrounding the tooth, which abrasion can lead to not only gingival recession, but also abrasion of the cervical area of the tooth itself. M. Pader, *Oral Hygiene Products and Practice,* Marcel Dekker, Inc., New York (1988), pages 169–170.

In addition to the "softness" of a brush, it is commonly accepted that one of the most important sources of oral abrasion caused by toothbrushing is related to the finish of the tip of the bristles. The end of a bristle may have sharp edges after trimming, as well as small ridges and burrs. By end rounding, the ends of the bristles are smoothed to minimize the possibility of incremental abrasion from such edges, ridges and burrs.

British Patent 490,124 and Swiss Patent CH 049277 disclose a solution to providing more bristle surface area by bundling or packing individual fibers together to form the tufts of toothbrushes. In the British Patent the tufts are held together by a synthetic resin, and within a tubular rod as in the Swiss Patent. German Patent DE 4417548 further discloses that bristles formed of very fine fibers clad in an elastic material to form the tufts further enhance cleaning while being softer to avoid injury to the gums.

There is a continuing need in the toothbrush art for bristles having more surface area to enhance the removal of plaque and food debris, while at the same time having a smaller diameter and end rounding, to be softer and reduce toothbrush abrasion.

SUMMARY OF THE INVENTION

The invention is a soft toothbrush bristle having enhanced surface area comprising a plastic sheath, which encloses a core of a plurality of microfilaments enclosed therein, which microfilaments project at their ends beyond the sheath; whereby, gentle cleaning of tooth and gum surfaces is realized as the microfilament ends penetrate into the narrowest grooves and depressions of the teeth and gums and into the spaces between them so that harm to the gums is avoided.

BRIEF DESCRIPTION OF THE DRAWINGS

For a fuller understanding of the nature of the invention, reference the following detailed description, taken in connection with the accompanying drawings in which.

DETAILED DESCRIPTION

Figure 1:
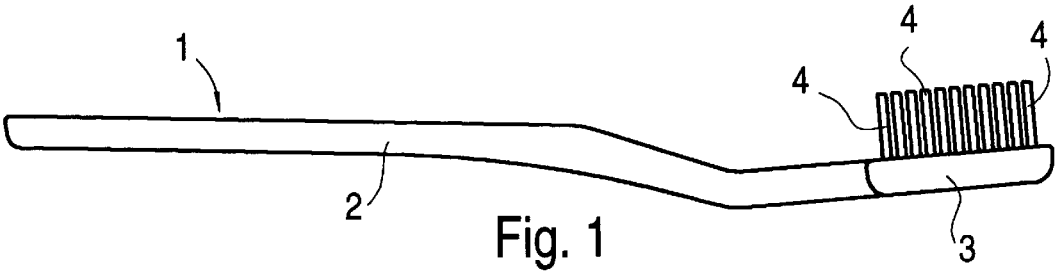
FIG. 1 is a side view of a toothbrush.
Figure 2:
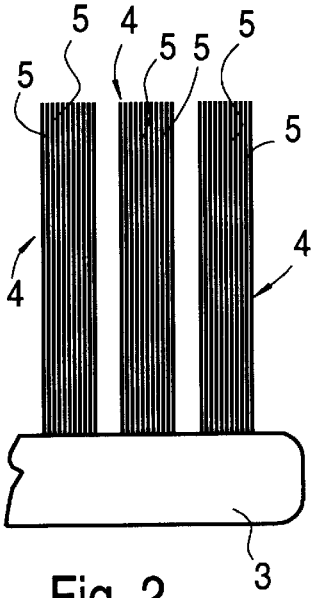
FIG. 2 is an enlarged view of a section of FIG. 1, showing the individual bristles comprising the toothbrush tufts.

Reference is made to FIG. 1, wherein a toothbrush is shown comprised, of a handle, 2, and a bristle carrier, 3, which is integral with said handle. Bristle clusters or tufts, 4, are attached to the bristle carriers, 3. As can be seen from FIG. 2, each tuft, 4, is comprised of a multiplicity of bristles, 5.

Figure 3:
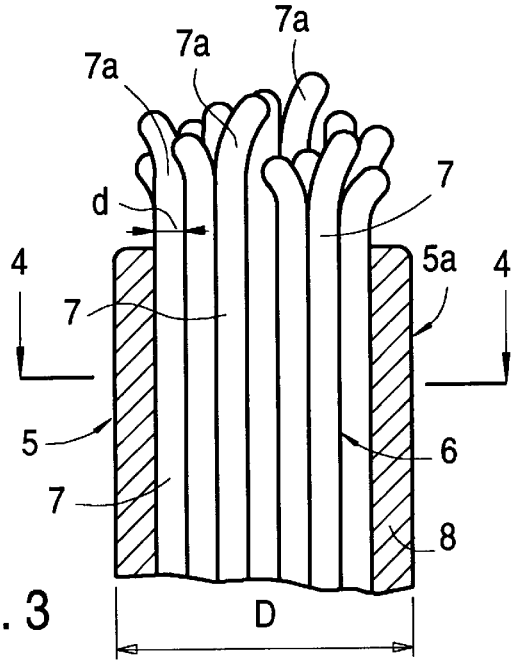
FIG. 3 is an enlarged illustration, the sheath in cross section, of the top of a single bristle.
Figure 4:
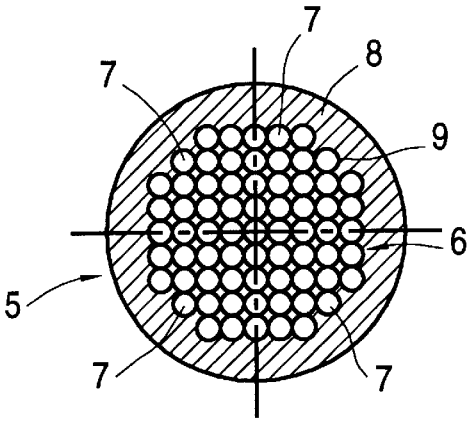
FIG. 4 is a section along line 4—4 of FIG. 3.

The structure of a single bristle can be observed by reference to FIG. 3 and FIG. 4. Each bristle has a core, 6, which is enclosed by a sheath, 8. The sheath, 8, is part of and integral with a plastic matrix, 9, in which the microfilaments, 7, are embedded. It is preferred that there are no voids or cavities in the plastic matrix, 9, within which the microfilaments, 7, are embedded. If there are no cavities or openings between the microfilaments, 7, the core, 6, and the sheath, 8, foreign substances e.g. microorganisms and particles, are prevented from penetrating into the bristle, 5.

The microfilaments, 7, and the plastic matrix, 9, may consist of the same or different plastic preferably a thermoplastic resin, such as a polyamide (e.g. nylon 6; 6,6; 6,10; 6,12; 6,9: 11; or 12), an acetyl resin, a polyester (e.g. polybutylene terephthalate-PBT), a fluoropolymer (e.g. poly (vinylidene difluoride)-PVDF: fluorinated ethylene-propylene resin-FEP), a polyacrylate, a polysulfone and combinations thereof. Preferably the thermoplastic resin is a polyamide, such as Dupont or BASF filament grade polyamides. As can be seen from FIG. 3, the filaments, 7, project beyond the sheath, 8, at the free end, 5*a*, of the bristle, 5, i.e. the end applied to the teeth. The microfilament ends so extend beyond the sheath in this way as the bristles, 5, are subjected to a commercial end rounding operation at their free end, 5*a*, as a result of which the sheath, 8, is mechanically removed to a greater extent than the microfilaments whose ends are rounded.

The core, 6, comprises at least 2 microfilaments, but, preferably 20 to 60 microfilaments, 7. The microfilaments, 7, have a thickness of from about 0.01 to about 0.08 mm, preferably from about 0.064 to 0.08 mm. As disclosed in U.S. Pat. No. 5,722,106, using known co-extrusion techniques for nylon, a 0.008" (0.2 mm) diameter filament fiber can be extruded and drawn down to as fine 0.0002" (0.005 mm) in diameter plus or minus 20%, at a temperature range of 500° to 550° F. Such a co-extrusion technique is preferably used to produce the bristles of the present invention by simultaneously coextruding the microfilaments and the surrounding sheath, or by sheathing pre-extruded microfilaments into a bristle. The overall bristle diameter is from about 0.1 to about 0.3 mm, preferably about 0.15 to about 0.25 mm.

Alternatively, the microfilament bristles can be formed by a coating process. In the coating process, 20 to 60 parallel strands of preformed continuous microfilament fibers are passed together through a bath of polymer solution composed of 5% polymer, such as nylon 6,12, in a suitable solvent such 67% ethanol. At the end of the bath the microfilament strands coated with the nylon are passed through a capillary tube of about 0.3 mm in diameter to form a continuous bristle. The continuous bristle of coated fibers is dried by exposure to hot air, to drive-off the solvent and then cut to individual bristle length, and end rounded prior to insertion into a head of a toothbrush. The toothbrush head is a flattened portion forming one end of a toothbrush, the toothbrush having an elongated body, wherein the other end is a handle for gripping. The bristles are inserted into the flattened head portion and secured in tufts, such tufts including a plurality of the microfilament containing bristles of the present invention.

Pre-extruded nylon microfilaments are available from RP Filtec, 6021 Emmenbrücke, Switzerland, or from Dupont (the Dupont nylon 6,12 microfilaments in a diameter of about 0.064 mm or greater under the tradename Tynex 612).

It is preferred that the sheath, 8, and the microfilaments, 7, differ visibly from one another to enhance the aesthetic appearance of the bristles and to provide an indication of the state of the toothbrush. This aesthetic distinction between the sheath, 8, and the microfilaments, 7, is achieved by either the sheath or microfilaments being clear and coloring the other, or coloring both the sheath and the microfilaments each with different colors. Such differing colors of the sheath, 8, and of the projecting microfilament ends, 7*a*, increase the ease in determining when the free bristle ends, 5*a*, have become worn away, i.e. when the projecting microfilament ends, 7*a*, extending therefrom have been abraded down to the sheath, 8, during use of the bristle.

Figure 5:
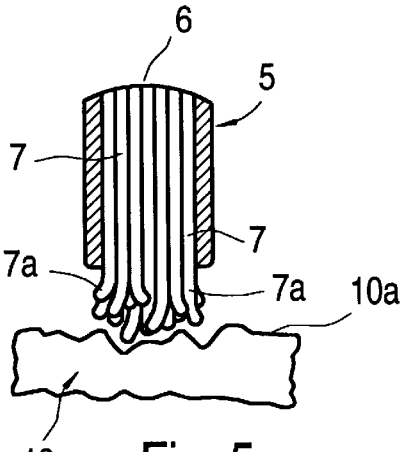
FIG. 5 is the free end of a single bristle shown from the perspective of a tooth to which it is being applied, the sheath in cross-section.

FIG. 5 illustrates the advantages obtained from the configuration of the bristles, 5, of the present invention. The fine-filament ends, 7*a*, projecting beyond the sheath, 8, form a fibrous structure, as a result of which it is possible to penetrate into the narrowest grooves and depressions in the surface, 10*a*, of a tooth, 10, and thus to achieve gentle, but very effective, cleaning. In addition, the gums are not harmed, the bristles, 5, having sufficient rigidity and enough flexibility to achieve the desired cleaning action.

We claim:

1. A toothbrush which comprises an elongated member having a flattened head portion at one end and a handle at the other, the flattened head portion containing tufts extending from the flattened head, each tuft being a plurality of bristles, each bristle being a plurality of microfilaments surrounded by a sheath, the microfilaments extending further from the flattened head than the sheath.

2. The toothbrush according to claim 1, wherein the microfilaments are of a different color than the sheath.

3. The toothbrush according to claim 1, wherein the microfilaments are from about 0.01 to 0.08 mm in diameter.

4. The toothbrush according to claim 1, wherein the bristles are from about 0.1 to about 0.3 mm in diameter.

5. The toothbrush according to claim 1, wherein the bristles are end rounded.

6. The toothbrush according to claim 1, wherein the bristles contain from 20 to 60 microfilaments.

* * * * *